US006609471B1

(12) United States Patent
Carrel et al.

(10) Patent No.: US 6,609,471 B1
(45) Date of Patent: Aug. 26, 2003

(54) SAILING BOAT HAVING MAST FORCE DETECTION

(75) Inventors: David M. Carrel, Bolyodoro, CA (US); John W. Oldham, III, San Jose, CA (US)

(73) Assignee: Sea Monster, Inc., Tiburon, CA (US)

( * ) Notice: Subject to any disclaimer, the term of this patent is extended or adjusted under 35 U.S.C. 154(b) by 0 days.

(21) Appl. No.: 10/142,471

(22) Filed: May 9, 2002

(51) Int. Cl.[7] ..... B63B 35/00

(52) U.S. Cl. ..... 114/39.11; 114/39.32; 114/90; 114/93

(58) Field of Search ..... 114/90, 91, 93, 114/39.11, 39.32

(56) References Cited

U.S. PATENT DOCUMENTS

| | | | | | |
|---|---|---|---|---|---|
| 3,157,148 | A | * | 11/1964 | Reed | 114/90 |
| 4,938,161 | A | * | 7/1990 | Blackmer | 114/39.17 |
| 4,958,581 | A | * | 9/1990 | Denison | 114/93 |
| 5,922,998 | A | * | 7/1999 | Zefira | 177/136 |
| 6,543,296 | B1 | * | 4/2003 | Bermudez | 73/828 |

* cited by examiner

*Primary Examiner*—Sherman Basinger
(74) *Attorney, Agent, or Firm*—Blakely Sokoloff Taylor & Zafman LLP

(57) ABSTRACT

A method of operating a sailing boat is provided, comprising detecting a force of a mast of a sailing boat on a mast step of a hull of the sailing boat, while the sailing boat is sailing across a body of water, and providing a reading of the force.

26 Claims, 4 Drawing Sheets

SAILING BOAT HAVING MAST FORCE DETECTION

BACKGROUND OF THE INVENTION

1). Field of the Invention

This invention relates to a sailing boat and, more specifically, to detection of a force in an elongate direction of a mast of the sailing boat.

2). Discussion of Related Art

Various factors may influence the performance of a sailing boat in racing conditions. One of the factors that influence the performance of the sailing boat is the positioning and shaping of the sails. The positioning and shaping of the sails depend to a large extent on the positioning of a mast of the sailing boat and any bends in the mast. The positioning and shape of the mast can be calculated by measuring, amongst others, a force in an elongated direction along the mast.

In some boats, the force can be increased by sliding more lift plates in between a lower surface of the mast and an upper surface of a mast step of a hull of the boat. The force can be decreased by removing lift plates. A jack is typically used to elevate the mast so that the lift plates can be inserted or be removed. The force can also be increased or decreased by tightening or loosening the rigging.

A rough indication of the force in the mast is obtained by elevating the mast slightly off the lift plates and then measuring the fluid pressure of the jacks that are used to elevate the mast. Once the mast is lowered into its sailing position, there is no way of accurately knowing what the force in that mast is. The disadvantage of this is that there are varying differences between the measured force when the mast is slightly raised, and the actual force when the mast is in its sailing position. A further disadvantage is that force measurements can only be made while the boat is at dock in a stationary position, i.e., not in "real time" while sailing.

BRIEF SUMMARY OF THE INVENTION

According to one aspect of the invention, a sailing boat is provided, having a hull, a mast, at least one detector, and an output device. The hull has a mast step. The mast extends upward from the mast step and has a lower end resting in a sailing position on the mast step. The detector detects a variable, indicative of a force exercised by the mast onto the mast step while resting in the sailing position. The output device is connected to the detector, and provides a reading indicative of the variable.

Preferably, no lifting jack is used to keep the mast in the sailing position.

The detector may detect strain deformation. The detector may, for example, include at least one strain gauge or a piezoelectric crystal.

The sailing boat may, for example, include at least a first lift plate. The detector may be secured to the lift plate. The lift plate may be removably located between an upper surface of the mast step and a lower surface of the mast, together with the detector and, after lifting up the mast relative to the mast step, be removable together with the detector from between the upper surface of the mast step and the lower surface of the mast.

The sailing boat may further include a load cell body, wherein the detector is secured to the load cell body, to jointly form a load cell. The load cell body may be mounted to the lift plate, and the detectors may detect strain deformation of a portion of the load cell body.

The load cell body may have a button portion standing proud of a surface of the lift plate, and the detector may detect depression of the button portion toward the lift plate.

The sailing boat may further include a second lift plate having a surface against which the button rests.

The sailing boat may further include a plurality of load cells around the mast.

The sailing boat may further include a plurality of detectors around the mast.

The output device may be mounted to the plate, and a change in the force exercised by the mast causing a direct change in the force displayed on the output device.

The reading provided by the output device is preferably force.

The sailing boat may further include rigging connected between an upper portion of the mast and the hull. The rigging may include a forestay, one or more backstays, and/or shrouds. The forestay may be connected between an upper portion of the mast and a front portion of the hull, and the backstay may be connected between the upper portion of the mast and a rear of the hull, the forestay and the backstay both being under tension to at least partially contribute to the force. The rigging may thus be adjustable to change the force.

According to another aspect of the invention, a combination lift and force detection plate is provided, including a lift plate and detector. The lift plate is insertable between a mast step of a hull and a mast of a sailing ship. The detector may be mounted to the lift plate, to be insertable with the lift plate between and to be removable with the lift plate from between the mast step and the mast. The detector may detect a force exercised by the mast thereon, and provide an output of the force.

The lift plate may have a slot which moves over a post that aligns the mast. The combination may further include a plurality of load cells around the mast.

According to a further aspect of the invention, a method of operating a sailing boat is provided, comprising detecting a force of a mast of a sailing boat on a mast step of a hull of the sailing boat, while the sailing boat is sailing across a body of water, and providing a reading of the force.

BRIEF DESCRIPTION OF THE DRAWINGS

The invention is further described by way of example with reference to the accompanying drawings, wherein.

DETAILED DESCRIPTION OF THE INVENTION

Figure 1:
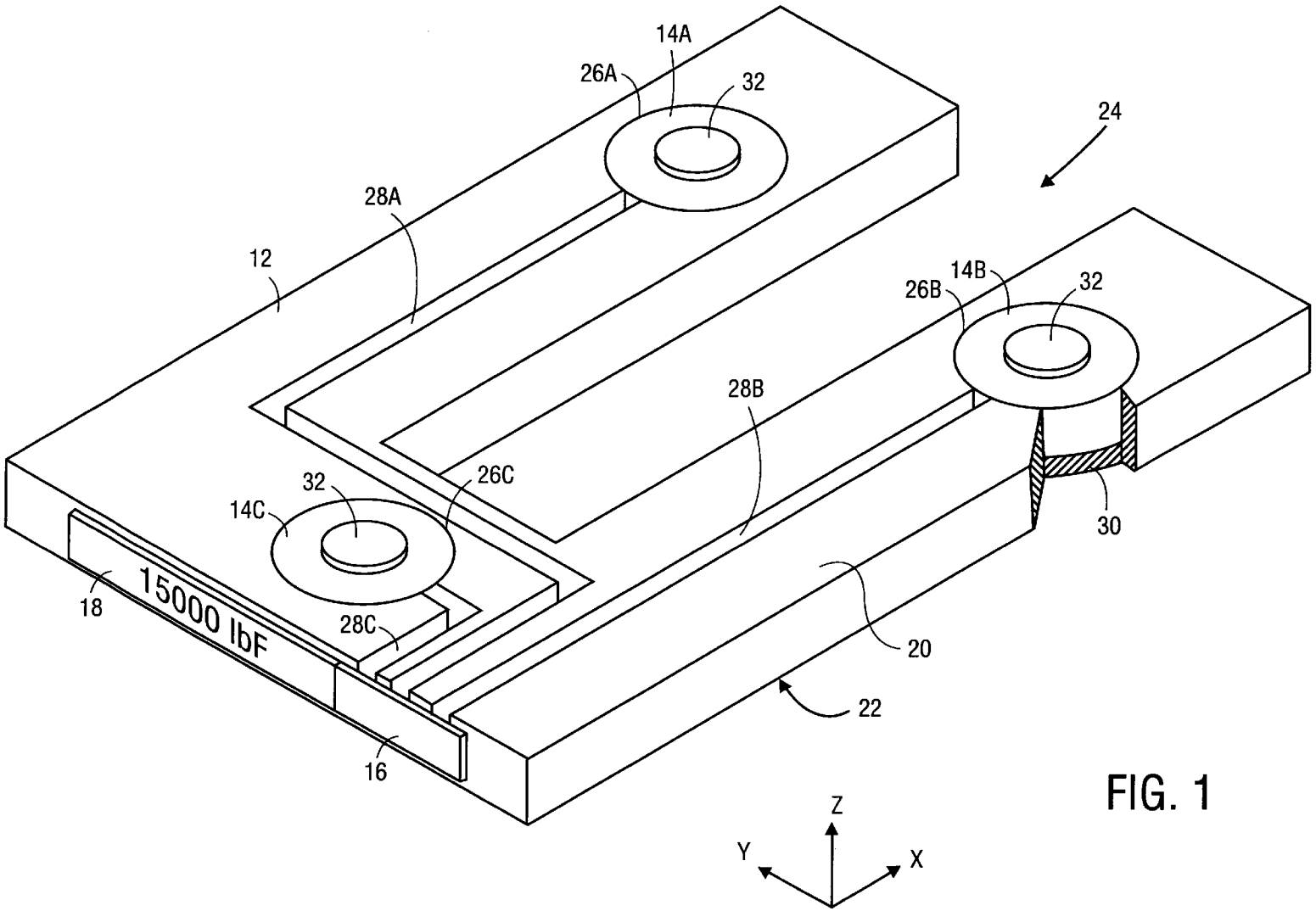
FIG. 1 is a perspective view of a combination lift and force detection plate according to an embodiment of the invention.

FIG. 1 of the accompanying drawings illustrates a combination lift and force detection plate 10, according to an embodiment of the invention, including a lift plate 12, three load cells 14A, 14B, and 14C, a signal converter 16, and an output device 18.

The lift plate 12 is made from a rigid material such as aluminium or titanium. The lift plate 12 has upper and lower surfaces 20 and 22 that are precision-machined to be extremely flat and in planes parallel to one another. The lift plate 12 has a length in an x-direction, and a width in a y-direction, the length being longer than the width. The lift plate 12 also has a height in a z-direction, both the length and the width being multiples of the height. A slot 24 is formed in the lift plate 12 along the length thereof, and is open toward the rear of the lift plate 12.

Three circular openings 26A, 26B, and 26C are machined into the upper surface 20 of the lift plate 12. Each opening 26A, B, or C is formed through a portion only of the lift plate 12, so that a respective land 30 remains below the respective opening 26A, B, or C. Three grooves 28A, 28B, 28C are formed in the upper surface 20 of the lift plate 12. Each groove 28A, B, or C extends from a respective opening 26A, B, or C to a front of the lift plate 12. The grooves 20A, B, and C are relatively shallow and much thinner than shown in the drawing.

Figure 2:
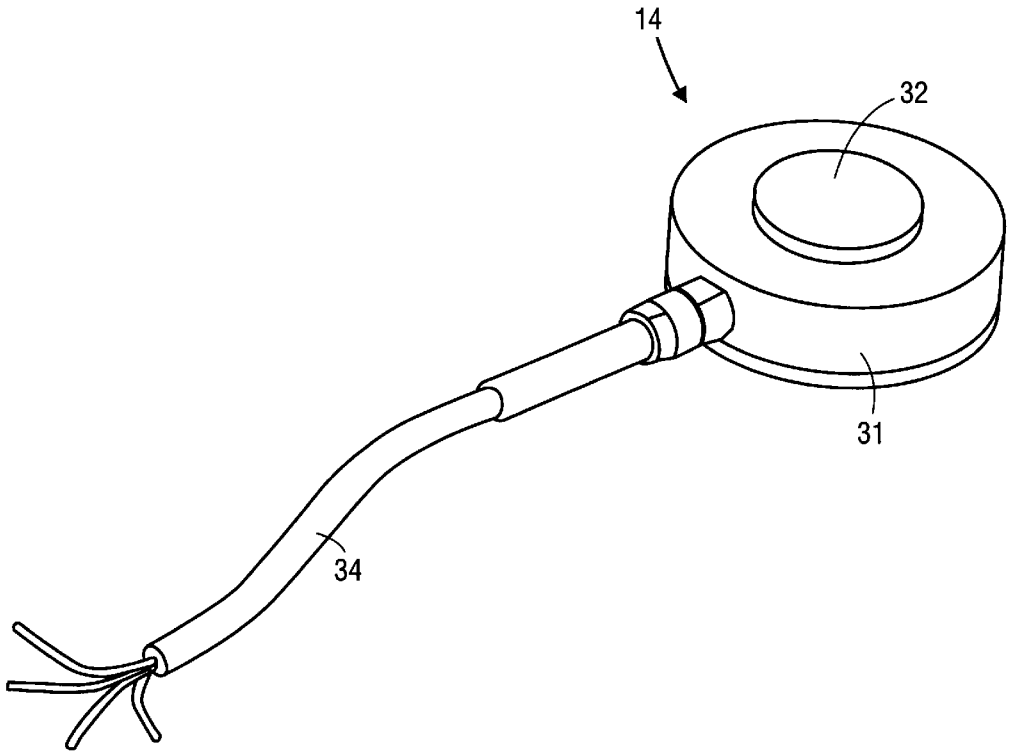
FIG. 2 is a perspective view of a load cell used in the combination of FIG. 1.

FIG. 2 illustrates one of the load cells 14. The load cell 14 has a load cell body 31 with an upper surface thereof forming a button 32. The load cell body 31 is typically made of a metal. Strain gauges (not shown) are secured to the load cell body 31. When the button 32 is depressed in a downward direction, and the load cell body 31 deforms, the strain gauges deform together with the load cell body 31. The strain gauges can thus detect depression of the button 32. In another embodiment, a piezoelectric crystal can be used instead of a strain gauge. A piezoelectric crystal provides an electric output in response to a physical load.

A cable 34 is secured to the load cell body 31 and connected to the strain gauges. An electric voltage can be applied to the strain gauges, and signals can be received from the strain gauges through the cable 34. The signals received through the cable are indicative of the force depressing the button 32.

Referring again to FIG. 1, a respective one of the load cells 14A, 14B, and 14C is inserted into a respective one of the openings 26A, 26B, and 26C. The buttons 32 stand proud of the surface 20 by approximately 0.125 mm. A respective cable (34 in FIG. 2) attached to a respective load cell 14A, 14B, or 14C is positioned so that it runs in a respective one of the grooves 28A, 28B, or 28C to the front of the lift plate 12. The signal converter 16 is attached to the front of the lift plate 12, and all the cables are connected to a signal converter 16. The signal converter 16 thus receives signals through all the cables from all the load cells 14A, B, and C.

The output device 18 may, for example, be a liquid crystal display output that can provide a visible reading. The output device 18 is connected to the signal converter 16. The signal converter 16 adds the signals received from the strain gauges of the load cells 14A, B, and C and converts the summation to a value, which is provided to the output device 18. The value is then displayed as a reading on the front of the output device 18. The reading on the output device 18 is the summation of the forces depressing the buttons of the load cells 14A, B, and C in a direction opposite to the z-direction. A change in the forces depressing the buttons causes a direct change in the reading of the output device 18. A change in the summation of the forces from 15000 lbF to 16000 lbF, for example, will cause a change in the reading from 15000 lbF to 16000 lbF.

Figure 3:
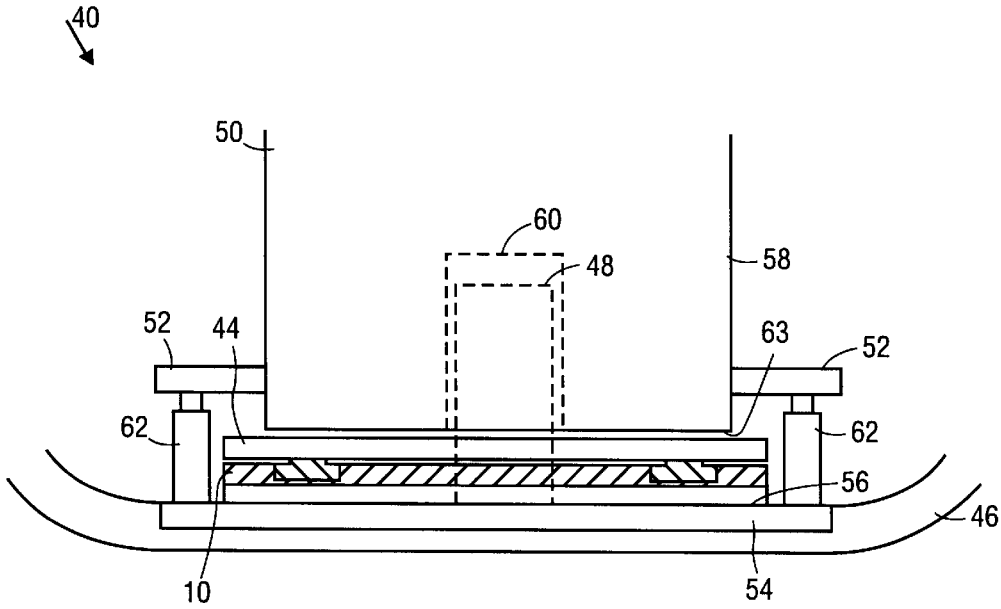
FIG. 3 is a partially cross-sectioned rear view illustrating components of a sailing boat, including a mast which is elevated into a raised position.

FIG. 3 illustrates components of a sailing boat 40, according to an embodiment of the invention, including the combination lift and force detection plate 10, two additional lift plates 42 and 44, a hull 46, a post 48, a mast 50, and a lifting rod 52.

The hull 46 has a mast step 54 having an upper surface 56. The post 48 is secured to the mast step 54 and extends upward therefrom. The mast 50 has a lower end 58. A cavity 60 is formed into a lower surface of the lower end 58 of the mast 50. The lifting rod 52 is located on opposing sides of the lower end 58 of the mast 50, and is secured to the lower end 58.

The cavity 60 is positioned over the post 48 so that the post 48 aligns the mast. Two jacks 62 are located between the lifting rod 52 and the mast step 54 on opposing sides of the mast 50. The jacks 62 are operated so that they engage the lifting rod 52 and elevate the lifting rod 52 together with the mast 50 into a raised position. This is normally done while in a stationary position at dock and with the sails down.

The lift plate 42 is inserted between the upper surface 56 and a lower surface 63 of the lower end 58 of the mast 50. The lift plate 42 is the same as the lift plate 12 illustrated in FIG. 1, except for the cutaways and components attached thereto. The slot (24 in FIG. 1) in the lift plate 42 allows for the lift plate 42 to be moved so that the post 48 moves down the slot.

The combination lift and force detection plate 10, with all its components, is then located on the lift plate 42 and inserted below the mast 50 in a similar manner. The lift plate 44 is then also inserted below the mast 50 and located on the combination lift and force detection plate 10. A lower surface of the lift plate 44 rests on the three buttons of the three load cells 14A, B, and C illustrated in FIG. 1. More than three load cells may be used, although at least three load cells are sufficient to create a plane.

Figure 4:
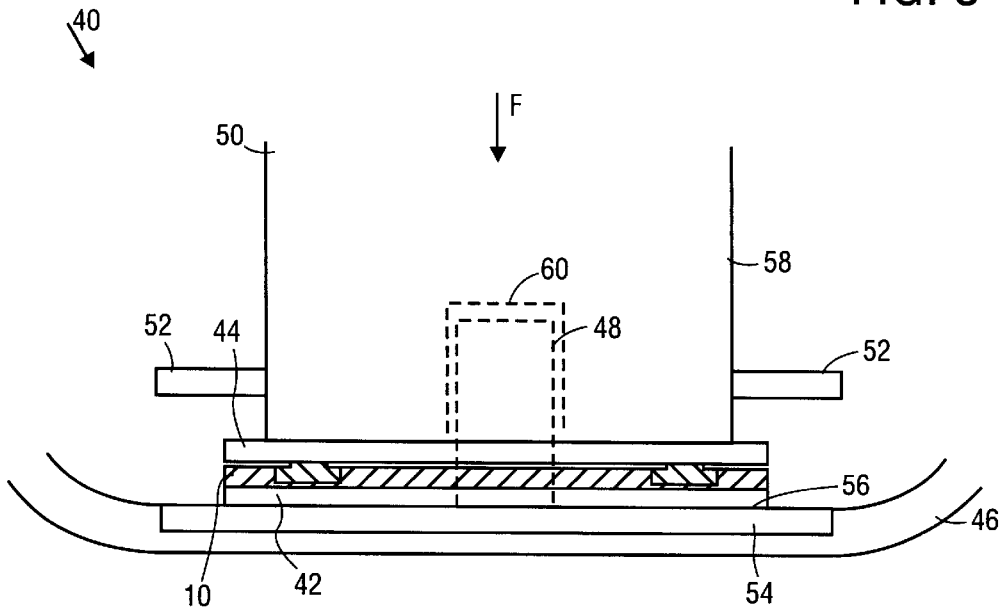
FIG. 4 is a view similar to FIG. 3, after the mast is lowered into a sailing position.

FIG. 4 illustrates the components of FIG. 3 after the jacks 62 are operated to lower the mast 50 into a sailing position on top of the lift plate 44, and after the jacks 62 are removed. The mast 50 now creates a downward force F onto the lift plate 44, and through the lift plates 12 and 42 onto the mast step 54. The force F is carried by the buttons of the load cells 14A, B, and C illustrated in FIG. 1. The reading provided by the output device 18 indicates the magnitude of the force F in the mast 50.

What should be noted is that the magnitude of the force F can be determined while the mast 50 is in its sailing position illustrated in FIG. 4. Moreover, the output device 18 can provide an indication of the magnitude of the force F while the sailing boat is sailing across a body of water. The sailing boat may, for example, be cruising at speeds of 5 knots, 10 knots, or more while the magnitude of the force F is displayed in "real time" on the output device 18. The output device 18 is also conveniently located directly on the lift plate 12, thereby allowing a person essentially to "read the plate." The magnitude of force can also be written to a computer storage medium such as a hard drive.

Figure 5:
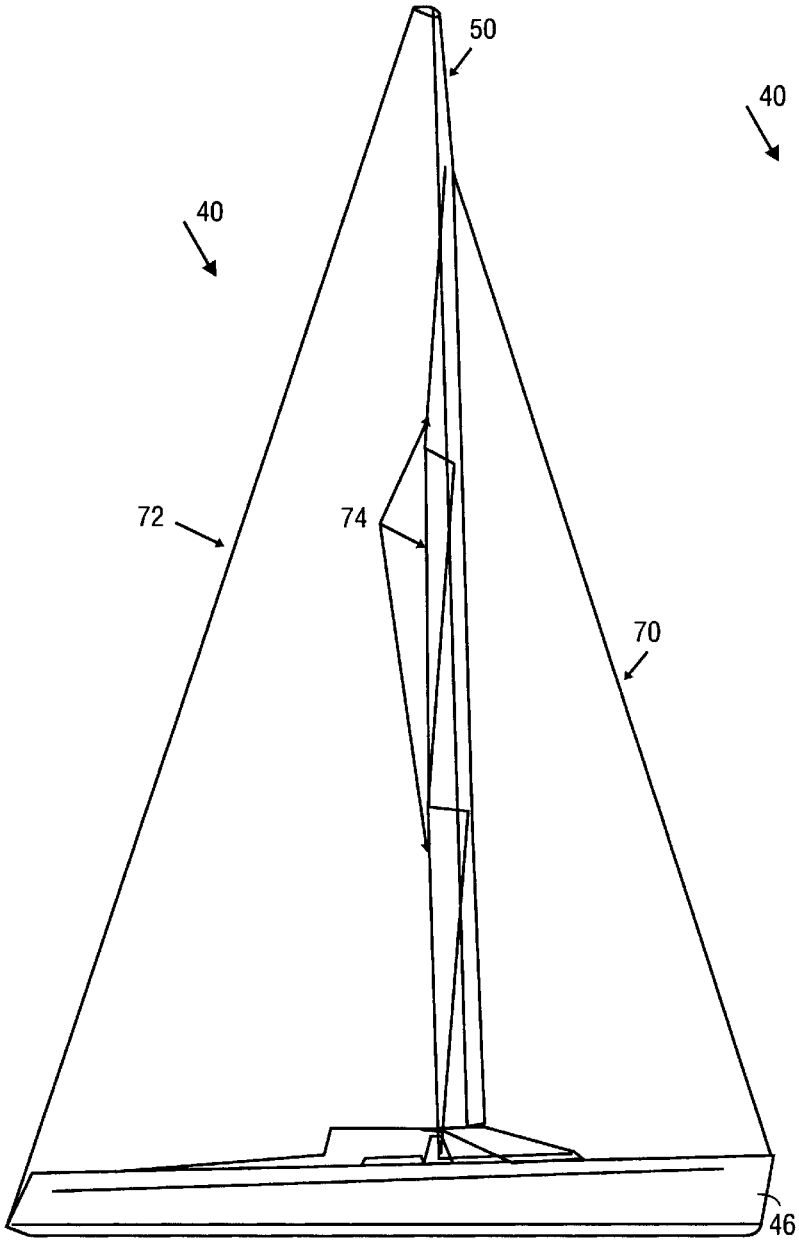
FIG. 5 is a side view of the sailing boat, illustrating further components thereof.
Figure 6:
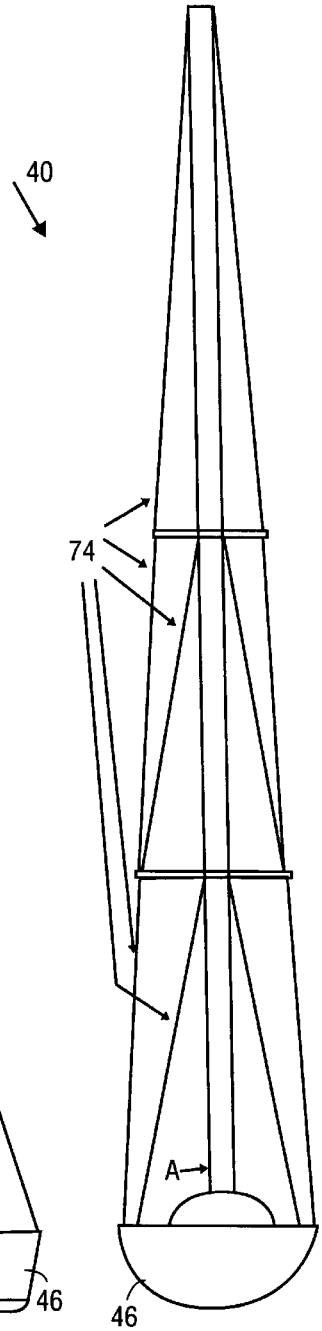
FIG. 6 is a rear view of the sailing boat.

FIG. 5 and FIG. 6 illustrate other components of the sailing boat 40, including a rigging in the form of a forestay 70, a backstay 72, and shrouds 74. The forestay 70 is connected between an upper end of the mast 50 and a front of the hull 46, and the backstay 72 is connected between the upper end of the mast 50 and a rear of the hull 46. In another embodiment, there may be more than one backstay, or no backstays at all. The shrouds 74 form a link between the side of the mast 50 at multiple positions along the mast 50 and sides of the hull 46. The forestay 70, backstay 72, and shrouds 74 are all under tension so that they contribute the force F together with the weight of the mast 50. The rigging can be tightened or loosened at any time including when the sails are up and the sailing boat 40 is sailing, with a corresponding change in the force F and a corresponding change in the readout on the output device (18 in FIG. 1).

While certain exemplary embodiments have been described and shown in the accompanying drawings, it is to be understood that such embodiments are merely illustrative and not restrictive of the current invention, and that this invention is not restricted to the specific constructions and arrangements shown and described since modifications may occur to those ordinarily skilled in the art.

What is claimed:

1. A sailing boat, comprising:

a hull having a mast step;

a mast extending upward from the mast step and having a lower end resting in a sailing position on the mast step;

at least one detector which detects a variable indicative of a downward force exercised by the mast onto the mast step while resting in the sailing position; and an output device connected to the detector and providing an output indicative of the variable.

2. The sailing boat of claim 1, wherein no lifting jack is used to keep the mast in the sailing position.

3. The sailing boat of claim 1, wherein the detector detects strain deformation.

4. The sailing boat of claim 1, wherein the detector includes at least one of a strain gauge and a piezoelectric crystal.

5. The sailing boat of claim 4, further comprising:

at least a first lift plate, the detector being secured to the lift plate, the lift plate being insertable between an upper surface of the mast step and a lower surface of the mast together with the detector and, after lifting of the mast relative to the mast step, being removable together with the detector from between the upper surface of the mast step and the lower surface of the mast.

6. The sailing boat of claim 5, further comprising:

a load cell body, wherein the detector is secured to the load cell body to jointly form at least part of a load cell, the load cell body being mounted to the lift plate, the detector detecting deformation of a portion of the load cell body.

7. The sailing boat of claim 6, wherein the load cell body has a button portion standing proud of a surface of the lift plate, the detector detecting depression of the button portion toward the lift plate.

8. The sailing boat of claim 7, further comprising:

a second lift plate, having a surface against which the button rests.

9. The sailing boat of claim 5, further comprising:

a plurality of detectors around the mast.

10. The sailing boat of claim 1, wherein the output device provides a visible reading indicative of the variable.

11. The sailing boat of claim 1, wherein the reading provided by the output device is force, a change in the force exercised by the mast causing a direct change in the force displayed on the output device.

12. The sailing boat of claim 1, further comprising:

a computing apparatus receiving the variable.

13. The sailing boat of claim 1, further comprising:

rigging connected between upper portions of the mast and the hull to at least partially contribute to the force, the rigging being adjustable to change the force.

14. A combination lift and force detection plate, comprising:

a lift plate which is insertable between a mast step of a hull and a mast of a sailing ship;

a detector mounted to the lift plate, to be insertable with the lift plate between and removable with the lift plate from between the mast step and the mast, the detector detecting a downward force exercised by the mast thereon, and providing an output of the force.

15. The combination lift and force detection plate of claim 14, wherein the detector detects deformation.

16. The combination lift and force detection plate of claim 15, wherein the detector includes at least one detector.

17. The combination lift and force detection plate of claim 16, further comprising:

a plurality of detectors around the mast.

18. The combination lift and force detection plate of claim 14, further comprising:

a load cell body, wherein the detector is secured to the load cell body to jointly form at least part of a load cell, the load cell body being mounted to the lift plate, the detector detecting deformation of a portion of the load cell body.

19. The combination lift and force detection plate of claim 18, wherein the lift plate has a slot which moves over a post aligning the mast, further comprising:

a plurality of said load cells around the mast.

20. The combination lift and force detection plate of claim 18, wherein the load cell body has a button portion standing proud of a surface of the lift plate, the detector detecting a force of the button portion toward the lift plate.

21. The combination lift and force detection plate of claim 14, further comprising:

an output device connected to the detector to provide a reading indicative of the force.

22. A method of operating a sailing boat, comprising:

detecting a downward force on a base of a mast of the sailing boat on a mast step of a hull of the sailing boat; and providing a reading indicative of the force without a lifting jack bearing a load between the mast and the mast step.

23. The method of claim 22, wherein the force is detected while the sailing boat is sailing across a body of water.

24. A method of operating a sailing boat, comprising:

detecting a downward force on a base of a mast of the sailing boat on a mast step of a hull of the sailing boat; and providing a reading indicative of the force while the mast rests on the mast step in its sailing position.

25. A method of operating a sailing boat, comprising:

detecting a downward force of a base of a mast of the sailing boat on a mast step of a hull of the sailing boat while the sailing boat is sailing across a body of water; and providing a reading indicative of the force.

26. The method of claim 25, wherein the sailing boat is sailing at a speed of at least 5 knots.

* * * * *